US006607416B2

(12) United States Patent
Kautz et al.

(10) Patent No.: US 6,607,416 B2
(45) Date of Patent: Aug. 19, 2003

(54) METHOD AND APPARATUS FOR SETTING X-RAY TUBE FILAMENTS

(75) Inventors: Allan D. Kautz, Naperville, IL (US); Salvatore G. Perno, Winfield, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 273 days.

(21) Appl. No.: 09/877,590

(22) Filed: Jun. 8, 2001

(65) Prior Publication Data

US 2002/0187711 A1 Dec. 12, 2002

(51) Int. Cl.[7] ..... H01J 9/06; H01J 9/10; H01J 9/16; H01J 9/36; B21F 45/00

(52) U.S. Cl. ..... 445/67; 445/29; 445/32; 445/64; 445/69; 140/71.6

(58) Field of Search ..... 445/29, 32, 64, 445/67, 69; 140/71.6

(56) References Cited

U.S. PATENT DOCUMENTS 3,286,323 A * 11/1966 Bastiaanse ..... 445/69
3,587,429 A * 6/1971 Belknap ..... 137/590
4,027,363 A * 6/1977 Belknap ..... 445/27

* cited by examiner

*Primary Examiner*—Vip Patel
*Assistant Examiner*—Matt Hodges
(74) *Attorney, Agent, or Firm*—Eugene E. Clair

(57) ABSTRACT

An apparatus (20) for setting a filament (22) on an electrode (24) comprises a body (52) having a central member (54) with a longitudinal axis (A—A), a first end member (56) and a second end member (58). The first and second end members (56, 58) are located at opposite ends of the central member (54) and each extends away from the longitudinal axis (A—A) thereby forming a recess (59). Each end member (56, 58) includes a surface generally facing the recess (61, 63) and an outer surface (74, 76). A bore (68) in the body is adapted to receive a retaining member (not shown) for mounting the body (52) to the electrode (24). A cavity (70) extends through the first end member (56) from its outer surface (74) to its recess facing surface (61). A cavity (80) in the second end member (58) opens toward the recess (59). The cavities (70, 80) in the first end member (56) and second end member (58) are located opposite one another across the recess (59).

27 Claims, 3 Drawing Sheets

METHOD AND APPARATUS FOR SETTING X-RAY TUBE FILAMENTS

BACKGROUND

The present invention relates to x-ray tubes and is particularly related to a method and apparatus for setting cathode filaments on a cathode cup for an x-ray tube.

In an operating x-ray tube, the position of the cathode filament with respect to the bottom of a slot that receives the filament is important in controlling a number of attributes of an electron beam emitted from the filament. Traditional methods for setting the operating position of the cathode filament on the cathode cup are subject to individual judgment and skill. It is difficult to make accurate and consistent placement of the cathode filament using these traditional techniques. Filaments which are not accurately placed have an undesired effect on the attributes of the electron beam.

The task of setting the filament in a cathode cup can result in scratches or other damage to the surface of the cathode cup. Such damage may cause sharp imperfections in the cathode, which can result in arcing at high voltage in an operating x-ray tube. Arcing can result in decreased x-ray tube life.

In General, setting a cathode filament begins with positioning a cathode filament at a desired location on the cathode to obtain the desired electron beam attributes. A cathode cup includes bores through the cup to receive the leads of the cathode filament. Hollow cylindrical ceramic insulators are inserted in the bores and extend through the cup. These insulators are brazed into the cathode cup. The filament is placed in the desired position by feeding filament leads through the filament is placed in the desired position by feeding filament leads through the hollow cylindrical ceramic insulators. The filament leads are then secured in the ceramic insulators and the filament is thereby supported in the cathode cup.

One presently practiced skill intensive method of positioning the filament at the desired location includes use of an optical microscope, equipped with a means for reading the location of the focal point from a reference location in units of length. Setting the desired location of the cathode filament relative to a surface of the cathode cup is initiated by inserting the cathode filament leads through the hollow cylindrical ceramic insulators. In order to position the cathode filament at the desired location, the microscope is first focused on the surface of the cathode cup and the microscope focus reading is recorded or zeroed. The microscope is then re-focused on a surface of the cathode filament and the microscope focus reading is noted. The location of the filament is adjusted to the desired location as necessary. Determining the cathode position reading with the focused microscope and the adjustment of the location of the cathode filament is conducted in an iterative process until the filament is at the desired filament setting for a specific x-ray tube application. The consistency, efficiency and accuracy of this process is influenced by the operator's visual perception and skill. Different operators may have different visual perception and skill levels in this iterative process, which can result in inconsistent placement of cathode filaments.

Once the cathode filament is at the desired location, the filament leads are mechanically crimped within the hollow cylindrical ceramic insulators. The crimps hold the cathode filaments in the desired location during the filament flashing operations. The cathode filament is typically flashed twice, the first flashing operation is to relieve stress and the second flashing operation is to strengthen the filament. The cathode filament can twist or kink from the desired location as the mechanical stress is relieved during the first flash. If this movement changes the position of the cathode filament, resetting the filament with the microscope is difficult. After the second flash, the cathode filament leads are laser welded to the hollow cylindrical ceramic insulators. Once the filament is set, kinks in the filament are removed by physically re-aligning the kinked portions while viewing the filament under the microscope. This filament re-alignment process is also subject to the operators perception and skill. Thus, the consistency and accuracy of re-aligning the kinked filament is subject to the same individual variations as the initial setting process.

For the foregoing reasons, there is a need for a less difficult method and apparatus for efficient, accurate and consistent setting and alignment of cathode filaments.

SUMMARY OF THE INVENTION

The present invention is directed to a method and apparatus that satisfies the need to provide accurate and consistent setting of cathode filaments in x-ray tubes. A filament setting fixture apparatus in accordance with one embodiment of the present invention includes a body with a central member having a longitudinal axis. The body also includes a first end member and a second end member which are respectively located at opposite ends of the central member. Each of the end members extend away from the axis, thereby forming a recess. Each end member includes a surface generally facing the recess and an outer surface. A bore in the body is adapted to receive a retaining member for mounting the body. A cavity extends through the first end member from its outer surface to its recess facing surface. A cavity in the second end member opens toward the recess. The cavities in the first end member and second end member located opposite one another across the recess.

In accordance with another aspect of the present invention, the apparatus includes a fixture for using a mandril to set a filament on an electrode. The fixture comprises a generally c-shaped body defining a recess. A bore extends through the body for receiving a securing member to attach the fixture to the electrode in a desired location. A pair of cavities are located opposite one another across the recess formed by the c-shaped body, each cavity for retaining one end of the mandril when the mandril is extending across the recess.

In accordance with another aspect of the invention, a method is provided for positioning an electrode filament on an electrode. The method comprises the steps of passing a first end of a mandril through a first cavity in a filament setting fixture and threading the electrode filament on the mandril. The first end of the mandril is placed in a second cavity in the filament setting fixture such that the mandril extends across a recess formed by the fixture. The filament setting fixture is positioned on the electrode at a desired location and is secured to the electrode.

The present invention may include, but is not limited to, any of the following advantages such as simple, accurate and consistent positioning of electrode filaments. The present invention provides the foregoing and other features hereinafter described and particularly pointed out in the claims. The present invention may include the foregoing advantages individually or in any combination as well as with the other features described in the following description.

The following description and accompanying drawings set forth certain illustrative embodiments of the invention. It is to be appreciated that different embodiments of the invention may take form in various components and arrangements of components. These described embodiments being indicative of but a few of the various ways in which the principles of the invention may be employed. The drawings are only for the purpose of illustrating a preferred embodiment and are not to be construed as limiting the invention.

BRIEF DESCRIPTION OF THE DRAWINGS

The foregoing and other features and advantages of the present invention will become apparent to those skilled in the art to which the present invention relates upon consideration of the following detailed description of a preferred embodiment of the invention with reference to the accompanying drawings, wherein.

DETAILED DESCRIPTION

Figure 1:
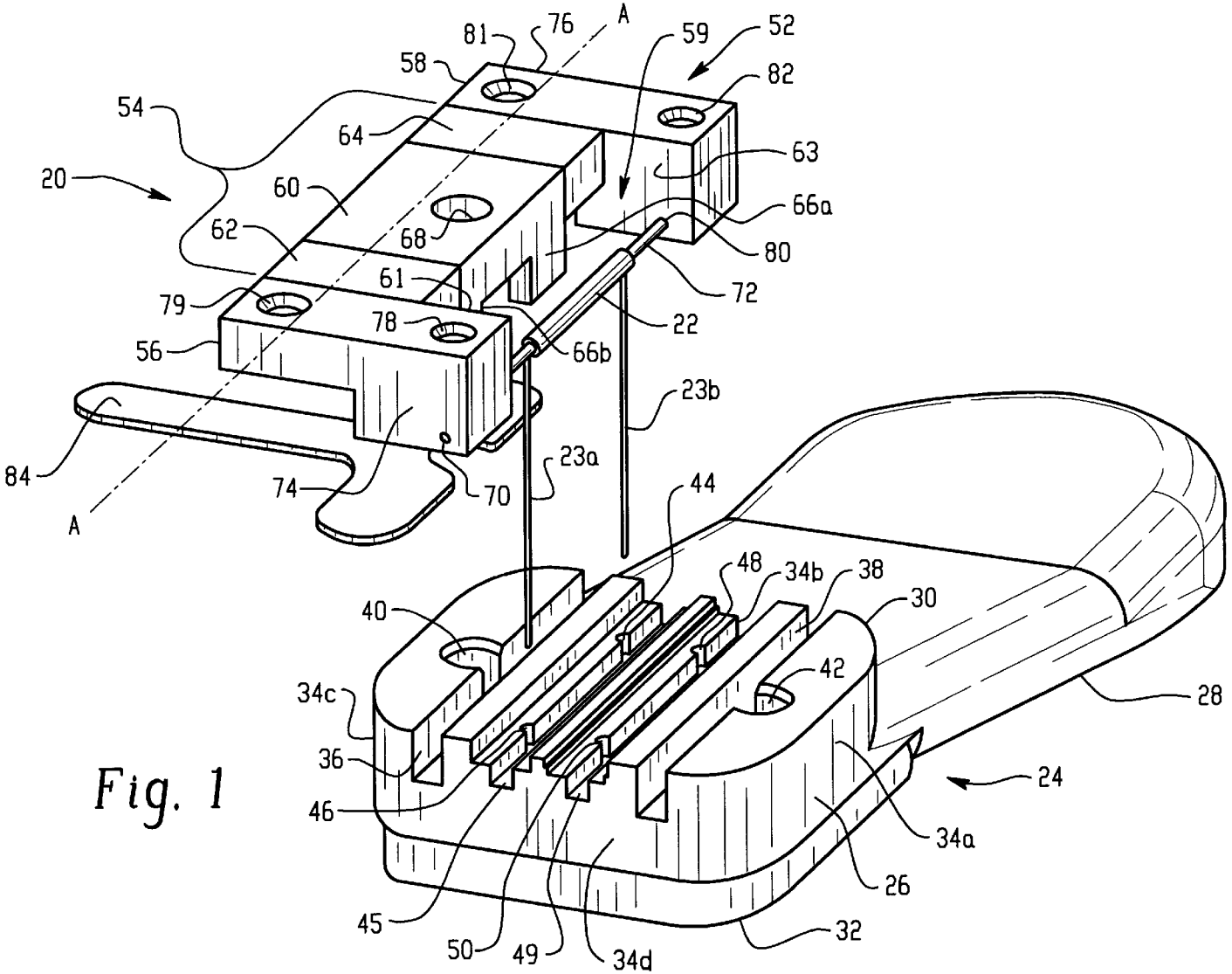
FIG. 1 is a perspective view of an apparatus in accordance with features of the present invention.

With reference to FIG. 1, an apparatus 20 is shown for use according to a method for setting a filament in an electrode structure. In this example, a cathode filament 22 is set in a cathode structure 24. The cathode filament 22 may be configured as a spiral wound filament with a hollow cylindrical core along a longitudinal axis. Other known filament configurations that can be threaded on a mandril may also be set using the apparatus and method of the present invention. The cathode filament 22 has filament leads 23*a* and 23*b*. The cathode structure 24 includes a cathode cup 26 attached to a support arm 28. Alternatively, the support arm 28 and cathode cup 26 may be manufactured from a single piece.

Figure 2:
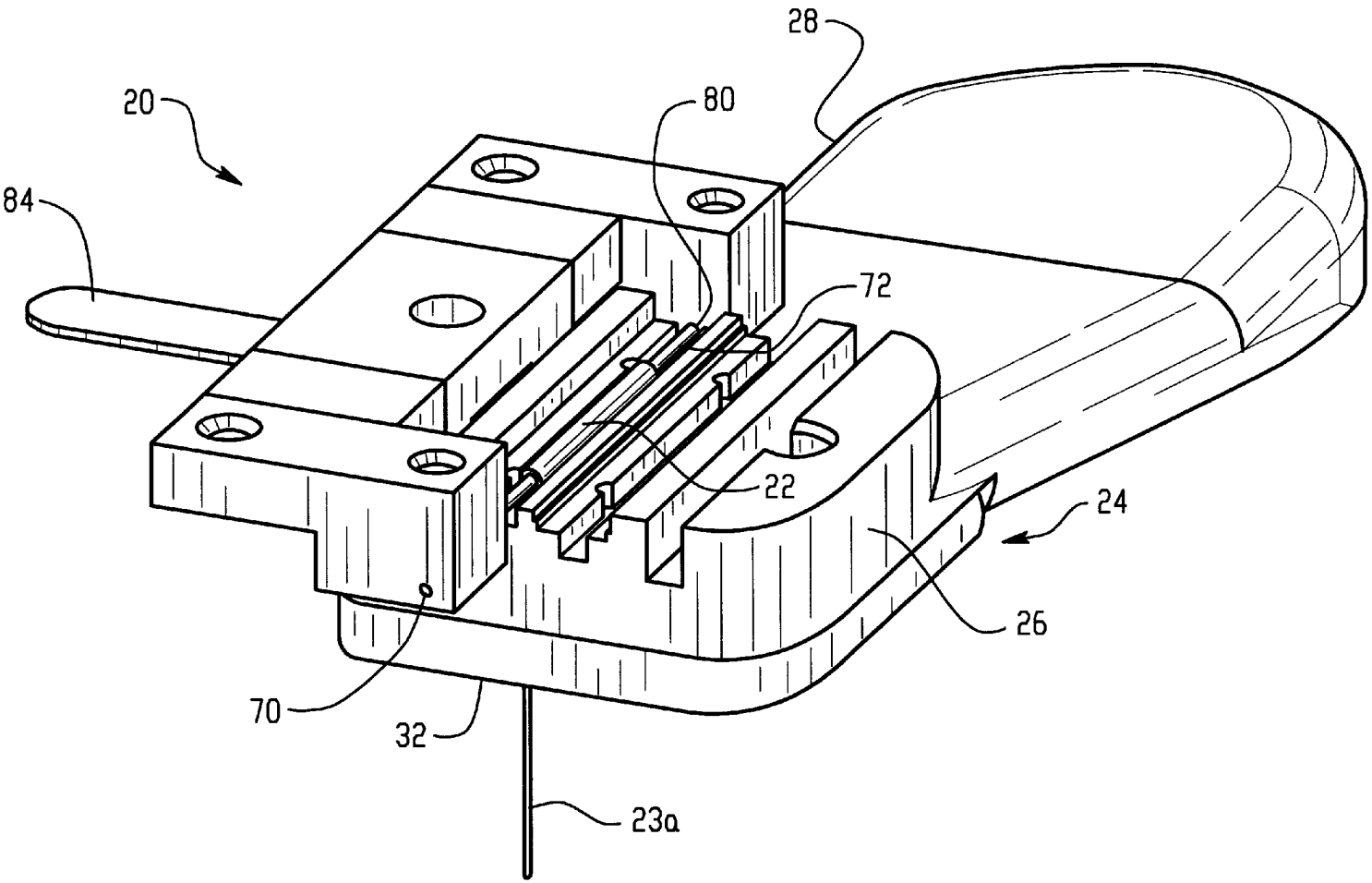
FIG. 2 is a perspective view of an apparatus in accordance with features of the present invention.

The cathode cup 26 includes a top surface 30 and a bottom surface 32. Four sidewall surfaces 34*a*,34*b*,34*c*,34*d* extend from the top surface 30 to the bottom surface 32 thereby defining the perimeter of the cathode cup 26. Keyways 36, 38 are located in the top surface 30 and extend from sidewall 34*b* to sidewall 34*d*. Threaded bores 40, 42 extend into the cathode cup 26 from the top surface 30 toward the bottom surface 32. Filament lead bores 44, 46 extend through the cathode cup 26. The filament lead bores 44, 46 are suitably positioned to provide for alignment of the filament 22 in a first filament groove 45. In a multi-cathode configuration, a second pair of filament lead bores 48, 50 similarly extend through the cathode cup 26. The lead bores 48, 50 are positioned to provide for alignment of a second filament (not shown) in a second filament groove 49. The filament lead bores 44, 46, 48, 50 are lined with cylindrical hollow ceramic insulators (not visible in the FIGURES), as is known in the art. The filament leads 23*a*, 23*b* to pass through the hollow ceramic insulators in the cathode cup 26 and extend past the bottom surface 32 (visible in FIG. 2).

The apparatus 20 includes a body 52 extending along an axis A—A. The body 52 includes a center portion 54, a first arm 56 and a second arm 58. Each of the arms 56, 58 are located on opposite ends of the center portion 54. The arms 56, 58 extend further away from the axis A—A than the center portion 54, thereby forming a generally C-shaped frame having a recess 59 between inner surfaces 61, 63 of the arms 56, 58 and the center portion 54.

The center portion 54 includes a segment 60 and insulator portions 60, 62 located at opposite sides, along the axis A—A, of the segment 60. The segment 60 is comprised of material suitable for securing the body 52 to the cathode that is a good thermal/electrical conductor such as copper. The insulator portions 62, 64 are comprised of a ceramic material. The segment 60 has keys 66*a*, 66*b* extending from its bottom surface which are adapted to be received in the keyway 36 of the cathode cup 26. A bore 68 extends through the segment 60 from its top surface through its bottom surface. The bore 68 can be aligned with the threaded bore 40 in the cathode cup 26 when the keys 66 are received in the keyway 36. A suitable retaining member (not shown) may be passed through the bore 68 and retainably received in the threaded bore 40 to secure the body 52 to the cathode cup 26. Any of a number of known retaining members may be used to secure the body 52 in the specific desired position such as screws, bolts, biased pins, etc. The bores 40, 42, rather than being threaded can be otherwise adapted to receive such alternate retaining members. The segment 60 of the center portion 54 is suitably attached to insulator portions 62, 64, for example, by brazing, friction fit or other structurally suitable method.

The arms 56, 58 are comprised of a conductive material, such as copper, and have respective outer surfaces 74, 76. The arms 56, 58 are suitably attached along a portion of their respective inner surfaces 61, 63 to the adjacent insulator portion 62, 64 of the center portion 54.

The first arm 56 includes a bore 70 (or cavity) through which a mandril 72 may be passed. The bore 70 extends through the arm 56 from the outer surface 74 to the inner surface 61. A threaded bore 78 extends from the top surface of the arm 56 until it intersects with the bore 70. The threaded bore 78 is adapted to receive a suitable retaining member (not shown) which is threadably engaged in the bore 78. The retaining member is used to secure the mandril 72 in the bore 70. A second threaded bore 79 is provided in the first arm 56 for receiving a threaded bolt (not shown), to facilitate attachment of a wiring terminal (not shown) for the supply of electric current.

The second arm 58 includes a bore 80 in which the mandril 72 is received. The bore extends through the arm 58 from the inner surface 63 to the outer surface 76. Alternatively, the bore 80 may only extend partially through the arm 58 such that the mandril 72 may be securely received in the bore to position the mandril and filament. A threaded bore 82 extends from the top surface of the arm 58 until it intersects with the bore 80. The threaded bore 82 is adapted to receive a suitable retaining member (not shown) which is threadably engaged in the bore 80 and may be used to secure the mandril 72 in the bore 80. A second threaded bore 81 is provided in the second arm 58 for receiving a threaded bolt (not shown), to facilitate attachment of a wiring terminal (not shown) to provide a path for electric current.

The mandril 72 is comprised of an electrically conductive material, such as tungsten or other material, that is suitable to retain the filament in the desired position during the flashing operations. In this example, the tungsten mandril can be previously flashed to produce the desired material characteristics for use in the present invention.

The wiring terminals (not shown) to be connected to the arms 56, 58 at their respective threaded bores 79, 81 are electrically connected to a suitable source of electric power (not shown) for flashing the filament. The components of the apparatus 20 which comprise a portion of the current path from the power source include the first arm 56, the electrically conductive mandril 72 and the second arm 58. One skilled in the art will appreciate that the source of electric power can be attached to the apparatus 20 to provide current through the conductive mandril 72 using other known suitable connectors and attachment members to either the body 52 or mandril 72.

A shim 84 is insertable between the cathode cup 26 and the body 52 to position the body 52 and the mandril 72, and thereby the filament 22, at the desired location with respect to the filament groove 45 in the cathode cup 26. Individual shims or a plurality of shims having different thicknesses may be used singularly or in combination to obtain a desired setting location of a filament 22. The shim 80 is comprised of a mechanically stable material not prone to corrosion that can withstand routine wear and tear under the described conditions of use in cathode manufacturing. An example of a suitable material is stainless steel.

The relative location of the keys 66*a*, 66*b* the keyways 36, 38, the threaded bores 40, 42, the bore 68 for the retaining member, the paired mandril receiving bores 70, 80 and shim(s) 84 may be used in any suitable combination with one another to securely position a filament at the desired location with respect to the cathode cup 26.

A method for using the apparatus 20 to set cathode filaments 22 includes passing a first end of the mandril 72 through the first bore 70 in the arm 56 of the body 52. Next the filament leads 23*a*, 23*b* are passed through the filament lead bores 44, 46 in the cathode cup and the filament 22 is threaded on the mandril 72 through the filament's hollow cylindrical tubular portion. The first end of the mandril 72 is placed in the second receiving bore 80 thereby having the mandril 72 extend across the C-shaped recess 59 formed by the center portion 54 and the arms 56, 58. Each end of the mandril 72 is retained in one of the arms 56, 58 of the body 52. In the described embodiment, the mandril is secured with a suitable retaining member in at least one of the threaded bores 78, 82. If required, the desired location of the filament 22 may be adjusted by placing a suitably dimensioned shim 84 (or plurality of shims) between the body 52 and the cathode cup 26. The body 52 is positioned on the cathode cup 26 thereby positioning the filament 22 at the desired location. The keys 66*a*, 66*b* are inserted into the keyway 36 to align the body 52. Finally, the body 52 is secured to the cathode cup 26 by placing and tightening a suitable threaded retaining member through the bore 68 in the segment 60 and threaded bore 40 in the cathode cup.

Once the filament 22 is positioned in the desired location the filament is secured to the cathode cup 26, for example, by crimping the filament in the filament lead bores 44, 46. After the filament is flashed and its position is confirmed as suitable for use in the x-ray tube, the filament leads 23*a*, 23*b* are secured to the cathode cup by welding e.g. laser welding. The mandril 72 is removed from the body 52. After removal of the mandril 72, the body is removed from the cathode cup by removing the retaining member in the bores 68 and 40. The cathode assembly is completed when a cathode focus cap (not shown) is secured to the cathode cup 26 generally encircling the perimeter of the set filaments.

Figure 3:
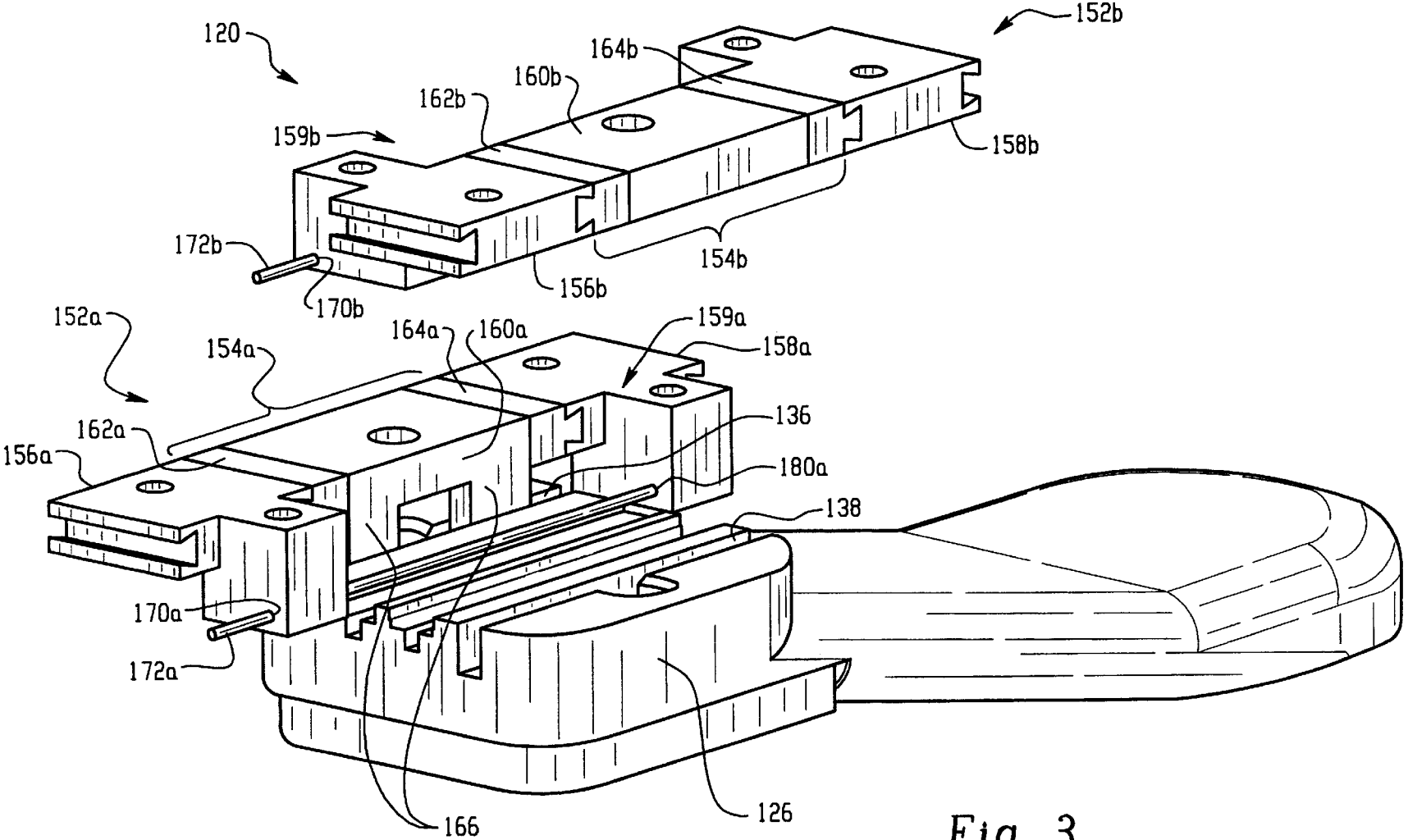
FIG. 3 is a perspective view of an apparatus in accordance with features of the present invention.

Another embodiment of an apparatus illustrating features of the present invention and its method of use is shown in FIG. 3. An apparatus 120 includes a first filament setting body 152*a* and a second filament setting body 152*b*, each for positioning a respective filament to be set at a desired location on a cathode cup 126. The bodies 152*a* and 152*b* include respective center portions 154*a* and 154*b*. Each body 152*a*, 156*b* has an associated first arm 156*a*, 156*b* as well as associated second arms 158*a*, 158*b*. Each of the arms 156*a*, 156*b*, 158*a* and 158*b* are located on opposite ends of their respective center portions 154*a*, 154*b*. The arms 156*a*, 156*b*, 158*a* and 158*b* extend away from their respective center portions 154*a*, 154*b* forming generally C-shaped frames with recesses 159*a*, 159*b* between inner surfaces of their arms 156*a*, 156*b*, 158*a* and 158*b* and their center portions 154*a*, 154*b*.

Each of the center portions 154*a*, 154*b* include a respective segment 160*a*, 160*b* comprised of material suitable for securing the bodies 152*a*, 152*b* to the cathode cup 126, in a manner similar to that described above. The segments 160*a*, 160*b* have keys 166 (not visible for body 152*b*) extending from their bottom surface which are adapted to be received in the associated keyways 136 or 138 of the cathode cup 126. The segments 160*a*, 160*b* of the center portions are suitably attached or bonded to insulator portions 162*a*, 162*b*, 164*a* and 164*b*. The insulator portions 162, 164 may be comprised of a ceramic material.

The arms 156*a*, 156*b*, 158*a* and 158*b* are comprised of a conductive material, such as copper, and are suitably attached or bonded along a portion of their respective inner surfaces to the adjacent insulator portion 162*a*, 162*b*, 164*a* and 164*b* of their respective center portions 154*a* and 154*b*.

The arms 156*a*, 156*b* include bores 170*a*, 170*b* through which mandrils 172*a*, 172*b* are passed. The bores extend through the arms 156*a*, 156*b*. The second arms 158*a*, 158*b* include bores 180*a* and 180*b* (not visible on body 152*b*) in which the mandril 172*a*, 172*b* are received. The mandril receiving bores 180*a*, 180*b* may extend through their arm or may only extend partially through the arm.

The mandrils 172*a*, 172*b* are secured in the bodies 152*a*, 152*b* in a manner similar to that described above. Suitable bores, retaining members and electrical terminations for securing the bodies, mandrils as well as completing electric current paths are provided to the apparatus in FIG. 3 similar to those features as described above. Duplicative description and element numbers have been omitted to simplify the illustration of the embodiment shown in FIG. 3, Shims (not shown) and other features for positioning the filaments in the desired locations are used in a manner similar to that described above with respect to FIGS. 1 and 2.

While a particular feature of the invention may have been described above with respect to only one of the illustrated embodiments, such features may be combined with one or more other features of other embodiments, as may be desired and advantageous for any given particular application.

From the above description of the invention, those skilled in the art will perceive improvements, changes and modification. Such improvements, changes and modification within the skill of the art are intended to be covered by the appended claims. For example, the filament 22 may be flashed by directly applying electric current through the filament rather than the mandril as described above. In this configuration, a non-electrically conductive mandril is used. The mandril can be comprised of boron nitride or zirconium nitride. Alternatively, the mandril may be conductive as described above and the arms 56, 58 may be comprised of electrically non-conducting material. These configurations also provide for application of electric current through the filament for the filament flashing operations.

A single O-shaped frame is contemplated by the inventors to provide for the option of setting either one or a plurality of filaments on an electrode structure with a single setting fixture. In such an arrangement, the arms extend to interconnect the two center portions to complete the O-shaped frame. The recess defined by the encircling arms and center sections receives the desired number of mandrils and filaments. Each arm includes at least one mandril receiving bore for aligning a filament. Additional pairs of mandril receiving bores in the respective arms may be provided to align additional filaments for setting, depending on the desired number of filaments to be set in an electrode and the desired configuration. In addition, a frame is contemplated that includes a C-shaped fixture having arms of an extended length that include multiple pairs of mandril receiving bores to set multiple filaments.

Having described a preferred embodiment of the invention, the following is claimed:

1. A filament setting fixture comprising:

a body having a central member with a longitudinal axis, a first end member and a second end member, the first and second end members located at opposite ends of the central member and extending away from the axis thereby forming a recess, each end member including a surface generally facing the recess and an outer surface;

a bore in the body adapted to receive a retaining member for mounting the body; and a cavity extending through the first end member from its outer surface to its recess facing surface, a cavity in the second end member, the cavity in the second end member opening toward the recess, the cavities in the first end member and second end member located opposite one another across the recess.

2. The apparatus of claim 1 wherein the cavity in the second end member extends through the second end member from its recess facing surface to its outer surface.

3. The apparatus of claim 1 including at least one key extending from the body.

4. The apparatus of claim 1 including a second cavity extending through the first end member from its outer surface to its recess facing surface and a second cavity in the second end member opening toward the recess facing surface of the second member, the respective second cavities in the first end member and second end member located opposite one another across the recess.

5. The apparatus of claim 1 wherein the central member includes a plurality of portions and at least one portion is electrically non-conductive.

6. The apparatus of claim 1 including a bore intersecting with one cavity in at least one end member, the bore adapted to receive a retaining member to secure an associated mandril in the cavity.

7. The apparatus of claim 1 including a mandril received in the cavity in the first end member and the cavity in the second end member, the mandril extending across the recess.

8. A fixture for using a mandril to set a filament on an electrode, the fixture comprising:

a generally c-shaped body defining a recess;

a bore extending through the body for receiving a securing member to attach the fixture to the electrode in a desired location; and a pair of cavities located opposite one another across the recess formed by the c-shaped body, each cavity for retaining one end of the mandril when the mandril is extending across the recess.

9. The apparatus of claim 8 including a key extending from the body for engaging a surface of the electrode to assist in aligning the fixture in the desired location.

10. The apparatus of claim 9 wherein the c-shaped body includes a plurality of portions and at least one portion is electrically non-conductive.

11. The apparatus of claim 9 including a bore intersecting with at least one of the cavities of the pair of cavities, the bore adapted to receive a retaining member to secure the mandril in the cavity.

12. The apparatus of claim 9 including a mandril received in the pair of cavities in the c-shaped body, the mandril extending across the recess.

13. A fixture for setting a filament on an associated electrode, the fixture comprising:

a body having a central portion, a first arm at one end of the central portion and a second arm at the opposite end of the central portion, the arms extending away from the central portion forming a recess;

means for aligning the body in a desired position on the associated electrode; and means for receiving an end of a mandril in each of the arms wherein the mandril extends across the recess in a desired position with respect to the associated electrode when the mandril is received in the arms and the body is aligned on the associated electrode.

14. The apparatus of claim 13 wherein the means for aligning includes means for securing the body to the associated electrode.

15. The apparatus of claim 13 wherein the means for aligning includes a key extending from the body to be received in a void in the associated electrode.

16. The apparatus of claim 13 including means for retaining the mandril in the means for receiving an end of the mandril.

17. The apparatus of claim 13 including means for applying electric current to the mandril.

18. The apparatus of claim 17 wherein the means for applying the electric current to the mandril is attached to each of the arms and the arms are electrically isolated from one another.

19. A method of positioning an electrode filament on an electrode, the method comprising the steps of:

passing a mandril through a first cavity in a filament setting fixture;

threading the electrode filament on the mandril;

placing an end of the mandril in a second cavity in the filament setting fixture, the mandril extending across a recess formed by the fixture;

positioning the filament setting fixture on the electrode at a desired location; and securing the filament setting fixture to the electrode.

20. The method of claim 19 wherein the step of positioning the filament setting fixture includes the step of passing at least one filament lead through the electrode.

21. The method of claim 19 wherein the step of positioning the filament setting fixture includes the step of placing a shim between the filament setting fixture and the electrode.

22. The method of claim 19 wherein the step of positioning the filament setting fixture includes the step of placing a key extending from the filament setting fixture into a keyway on the electrode.

23. The method of claim 19 including the steps of:

securing the filament to the electrode;

removing the mandril; and removing the filament setting fixture from the electrode.

24. The method of claim 23 including the step of flashing the filament prior to the step of securing the filament to the electrode.

25. A fixture for using a mandril to set a filament on an electrode, the fixture comprising:

a generally c-shaped body defining a recess, the c-shaped body includes a plurality of portions and at least one portion is electrically non-conductive;

a key extending from the body for engaging a surface of the electrode to assist in aligning the fixture in a desired location;

a bore extending through the body for receiving a securing member to attach the fixture to the electrode in the desired location; and a pair of cavities located opposite one another across the recess formed by the c-shaped body, each cavity for retaining one end of the mandril when the mandril is extending across the recess.

26. The apparatus of claim 25 including a mandril received in the pair of cavities in the c-shaped body, the mandril extending across the recess.

27. The apparatus of claim 26 including a bore intersecting with one of the cavities of the pair of cavities, the bore adapted to receive a retaining member to secure the mandril in the cavity.

* * * * *